United States Patent [19]

Hauchard et al.

[11] Patent Number: 4,969,845

[45] Date of Patent: Nov. 13, 1990

[54] ELECTRIC TERMINAL CONNECTOR

[75] Inventors: Patrick Hauchard, Deville les Rouen; Francois Loisel, Maromme, both of France

[73] Assignee: Legrand, Maromme, France

[21] Appl. No.: 327,532

[22] Filed: Mar. 23, 1989

[30] Foreign Application Priority Data

Mar. 29, 1988 [FR] France ..... 88 04062

[51] Int. Cl.[5] ..... H01R 4/18

[52] U.S. Cl. ..... 439/750; 439/879

[58] Field of Search ..... 439/738, 741, 750, 937, 439/588, 603, 865, 866, 879, 891; 174/74 R, 75 R

[56] References Cited

U.S. PATENT DOCUMENTS

| | | | |
|---|---|---|---|
| 2,715,764 | 8/1955 | Pierce | 29/155.55 |
| 2,823,249 | 2/1958 | Curtiss | 439/588 |
| 2,964,171 | 12/1960 | Chadwick | 439/877 |
| 3,146,519 | 9/1964 | Redwine | 29/155.55 |
| 3,452,321 | 6/1969 | Carissimi et al. | 439/483 |
| 3,467,764 | 9/1969 | Knapp | 174/74 R |
| 3,936,132 | 2/1976 | Hutter | 439/578 |
| 4,447,109 | 5/1984 | Hobart, Jr. | 439/874 |

FOREIGN PATENT DOCUMENTS

| | | | |
|---|---|---|---|
| 0117166 | 8/1984 | European Pat. Off. . | |
| 1468859 | 2/1967 | France . | |
| 2468224 | 4/1981 | France . | |
| 2543369 | 9/1984 | France | 439/750 |
| 2579836 | 10/1986 | France . | |
| 337895 | 3/1955 | Switzerland . | |

*Primary Examiner*—Gary F. Paumen

*Attorney, Agent, or Firm*—Charles E. Brown; Brown, Charles A.

[57] ABSTRACT

An electric terminal connector comprises a generally tubular metal part adapted to fit over the previously bared end of the conductive core of an insulated electric conductor. An insulative sleeve has a front portion adapted to be engaged with this metal part and a rear portion larger than the front portion adapted to fit over the corresponding end of the insulation of the electric conductor. The insulative sleeve comprises a transverse shoulder on its inside. The rear portion of the metal part is straight and its end is adapted to bear on this transverse shoulder. There is at least locally between the metal part and the insulative sleeve a film of adhesive which fastens them together. In line with at least the transverse shoulder the internal surface of the insulative sleeve has a diameter at most equal to that of the inside surface of the metal part.

20 Claims, 1 Drawing Sheet

ELECTRIC TERMINAL CONNECTOR

BACKGROUND OF THE INVENTION

1. Field of the Invention

The present invention is generally concerned with wiring accessories adapted to fit over the previously bared end of the conductive core of an insulated electric conductor in order to facilitate and render more secure the connection to a terminal of any kind, especially when the conductive core comprises multiple strands.

It is more particularly directed to wiring accessories usually referred to as electric terminal connectors comprising a generally tubular metal part adapted to fit over the previously bared end of the conductive core of the insulated electric conductor concerned and an insulative sleeve having a front portion engaged with the metal part and a rear portion larger than the front portion adapted to fit over the corresponding end of the insulation of the electric conductor.

2. Description of the Prior Art

One of the problems to be overcome in the manufacture of electric terminal connectors of this kind concerns the fastening together of the metal part and the insulative sleeve.

At present this is usually done by overmolding.

This is the case, for example, with the electric terminal connector which is the subject matter of French patent No. 1 468 859.

For anchoring it into the insulative sleeve the metal part has at the inner end a frustoconcial enlargement with both sides of which the synthetic material consituting the insulative sleeve is in contact.

Although this arrangement has proved satisfactory and may continue to prove satisfactory it has the following disadvantages.

Firstly, and most importantly, it is difficult to place the metal part in the mold for overmolding the insulative sleeve, which is detrimental to productivity and therefore to manufacturing cost.

This difficulty is accentuated if, in order to obtain a plurality of electric terminal connectors disposed one after the other in a necklace-like strip as described for example in French patent No. 2 468 224, a plurality of metal parts disposed side by side in the same mold are overmolded simultaneously.

This is why in practise such electric terminal connectors are usually manufactured individually.

In an electric terminal connector with the insulative sleeve overmolded in this way onto the metal part, if the molding interface between the insulative sleeve and the metal part is not properly controlled (and this is not necessarily a simple matter), the molding interface can constitute an obstacle to some strands of the conductive core to be inserted into the metal part and so block the strand or strands concerned. This represents an impediment to correct placing of the electric terminal connector currently being fitted, which may lead to its rejection, and (if the electric terminal connector is eventually fitted despite this difficulty) can lead to problems at a later stage, for example if the strands that were blocked project from the electric terminal connector or are broken off and escape from it. This is quite independent of the effect of any such blocking of strands on the electrical quality of the connection that results.

Finally, and in any event, the mechanical characteristics of the electric terminal connector obtained do not depend only on the inherent characteristics of the metal part and the insulative sleeve constituting it, but also on the quality of the overmolding operation, and this is more difficult to control.

It has also been proposed previously to join the insulative sleeve to the metal part of an electric terminal connector by crimping.

This is the case, for example, in published French patent application No. 2 579 836 and U.S. Pat. No. 2,964,171.

After it is inserted into the previously manufactured insulative sleeve the inside end of the metal part is expanded so that its shape matches the corresponding portion of the sleeve.

However, the risks of blocking and the mechanical characteristics disadvantages resulting from the assembly method used, as briefly explained hereinabove for assembly by overmolding, are encountered in much the same way or even in a more serious way with assembly by crimping.

Given the quality of modern adhesives and the possibility of applying accurately measured amounts of such adhesives, the invention proposes to use an assembly method based on adhesive bonding, with arrangements specifically directed to facilitating such adhesive bonding.

SUMMARY OF THE INVENTION

The present invention consists in an electric terminal connector comprising a generally tubular metal part adapted to fit over the previously bared end of the conductive core of an insulated electric conductor and an insulative sleeve having a front portion adapted to be engaged with said metal part and a rear portion larger than said front portion adapted to fit over the corresponding end of the insulation of the electric conductor, in which connector said insulative sleeve comprises internally a transverse shoulder, the rear portion of said metal part is straight and its end is adapted to bear on said transverse shoulder, there is at least locally between said metal part and said insulative sleeve a film of adhesive to fasten them together and in line with at least said transverse shoulder the internal surface of said insulative sleeve has a diameter at most equal to that of the inside surface of said metal part.

All risk of blocking is eliminated and the overall mechanical characteristics obtained depend only the inherent characteristics of the metal parts and the insulative sleeves used, and not on how they are joined together.

Also, manufacture in necklace-like form is advantageously enabled either in sections or in continuous strip form, the metal parts being placed one by one into the insulative sleeves previously manufactured in necklace form.

This results in an increased rate of manufacture and reduced implementation and maintenance costs.

The front portion of the insulative sleeve preferably has an internally enlarged section at its open end.

Apart from the fact that this enlarged section facilitates the insertion of the metal part when assembling the connector, it constitutes for the adhesive used for such assembly an expansion chamber adapted to compensate the variation in volume due to inevitable manufacturing tolerances of the insulative sleeve and on the metal part, so eliminating or at least minimizing running of the adhesive.

Near the transverse shoulder the internal surface of the front portion of the insulative sleeve preferably has at least one projecting centering facet disposed obliquely to the axis of the connector and extending towards the transverse shoulder. In practise it has a plurality of such facets.

The advantageous result of this is reliable centering of the metal part in the insulative sleeve. Being properly centered, the metal part cannot possibly give rise to any blocking during insertion of the electric conductor concerned and it is equally certain with regard to the adhesive bond employed that a homogeneous thickness can be achieved all around the metal part, to the benefit to the quality of its assembly to the insulative sleeve.

If required this assembly by adhesive bonding may be combined with one or more expansions of the metal part into the insulative sleeve.

In accordance with the invention, however, such expansions are at locations spaced from the transverse shoulder inside the insulative sleeve.

The inner end of the metal part, meaning that which abutts against the transverse shoulder inside the insulative sleeve, therefore remains straight and is not subject to any deformation by crimping. The advantages of eliminating all risk of blocking are therefore not compromised.

The front portion of the insulating sleeve of the electric terminal connector in accordance with the invention is preferably generally cylindrical, as is its rear portion, and is relatively thin.

Because it is relatively thin, this portion can advantageously cope better with deformation of the metal part when it is crimped to the bared end of the conductive core of the electric conductor. By minimizing the corresponding stresses, this minimizes the risk of the adhesive film between the insulative sleeve and the metal part peeling.

This relative thinness also achieves an advantageous saving in materials.

When the electric terminal connector is inserted into any form of connecting terminal the thinner front section of the insulative sleeve of the electric terminal connector in accordance with the invention must be prevented from entering the connecting terminal itself, as this may be prejudicial to the required electrical connection. To this end the front portion of the insulative sleeve has on its exterior at least one projecting fin constituting a guard. This prevents or at least minimizes penetration of the insulative sleeve into the connecting terminal.

In this way an advantageous compromise is achieved between the required deformation capability of the front section and the necessity to prevent it being inserted into a connecting terminal.

The characteristics and the advantages of the invention will emerge from the following description given by way of example and with reference to the appended diagrammatic drawing.

DESCRIPTION OF THE PREFERRED EMBODIMENTS

Figure 1:
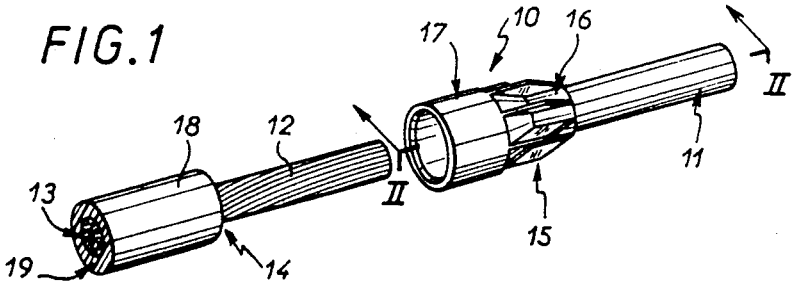
FIG. 1 is a perspective view of an electric terminal connector in accordance with the invention and the end of the conductor to which it is to be fitted.
Figure 2:
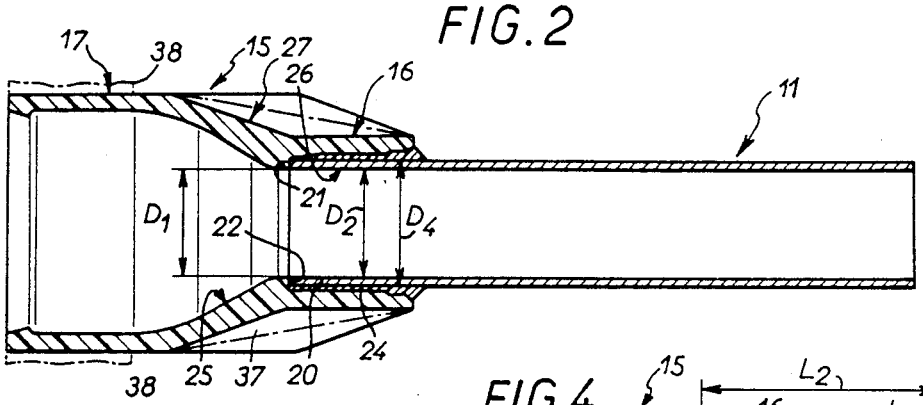
FIG. 2 is a view of the electric terminal connector in axial cross-section on the line II—II in FIG. 1 and to a larger scale.
Figure 3:
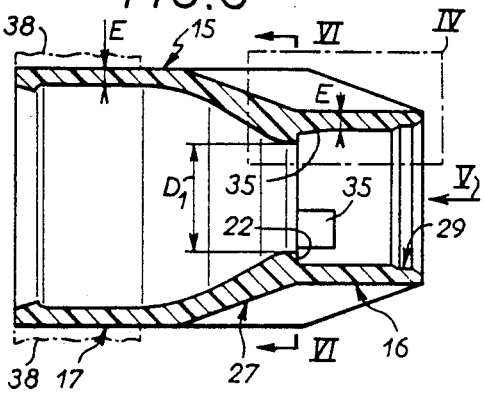
FIG. 3 is a view in axial cross-section and to the same scale as FIG. 2 of the insulative sleeve of this electric terminal connector.
Figure 4:
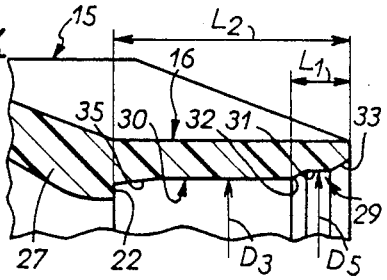
FIG. 4 shows to a larger scale the detail of FIG. 3 marked IV in FIG. 3.

As shown in the figures, the electric terminal connector 10 in accordance with the invention comprises a generally tubular metal part 11 which is adapted to fit over the previously bared end 12 of the conductive core 13 of an insulated electric conductor 14 and an insulative sleeve 15 having a front portion 16 engaged with the aforementioned metal part 11 and a rear portion 17, larger than the front portion 16, adapted to fit over the corresponding end 18 of the insulation 19 of the electric conductor 14.

In accordance with the invention the metal part 11 has at least its inner end, which is entirely straight, bearing through its edge 21 against a transverse shoulder 22 inside the insulative sleeve 15 and there is at least locally between the metal part 11 and the insulative sleeve 15 a film of adhesive 24 for fastening them together. In line with at least said transverse shoulder 22 of the insulative sleeve 15 the inside surface 25 of the latter has a diameter D1 at most equal to that D2 of the inside surface 26 of the metal part 11.

By the inner end 20 of the metal part 11 there is meant in this instance the portion of this metal part which is enclosed in the insulative sleeve 15 immediately adjacent the corresponding edge 21.

As previously mentioned, in accordance with one aspect of the invention this inner end 20 at least is entirely straight.

This means that it is free of any frustoconical deformation of the type used when its assembly to the insulative sleeve 15 has to be done by overmolding or crimping.

In other words, and in accordance with this aspect of the invention, the inner end 20 of the metal part 11 is continuously in alignment with its main part.

In the embodiment shown in FIGS. 1 through 6 the metal part 11 is entirely straight in this way over its entire length.

In other words, it is not deformed at any point.

This does not necessarily imply that it is cylindrical, however.

On the contrary, although in the embodiment shown by way of example the metal part 11 is generally cylindrical it could equally well be more or less frustoconcial, converging in the direction away from the insulative sleeve 15.

Similarly, although in this embodiment the metal part 11 forms a shank circumferentially closed upon itself without any discontinuity of any kind, like a stamped or drawn tube, the metal part 11 could equally well be produced by rolling an initially flat blank and therefore feature a longitudinal slit that is straight or oblique, rectilinear or curvilinear and either open or closed, by welding for example.

In the embodiment shown and in accordance with another aspect of the invention the front portion 16 of the insulative sleeve 15 is generally cylindrical and it is joined to the generally cylindrical rear portion 17 by a generally frustoconical middle portion 27.

Internally the front portion 16 has a larger section 29 at its open end, meaning the end facing towards the metal part 11.

In practise the internal surface of this front portion 16 of the insulative sleeve 15 comprises in succession and starting from the transverse shoulder 22 a first section 30 with an average diameter D3 slightly larger than the average outside diameter D4 of the inner end of the metal part 11 and a larger second section 29, previously mentioned, with an average diameter D5 greater than that D3 of the first section.

The inside surface of the larger section 29 of the front portion 16 of the insulative sleeve 15 comprises a substantially cylindrical middle section 31 between two substantially frustoconcial end sections through one of which (32) it merges with the first section 30, which is itself generally cylindrical, and the other of which (33) forms an insertion-assisting chamfer at the open end of the sleeve.

The axial length L1 of this internally enlarged section 29 of the front portion 16 of the insulative sleeve 15 is only a fraction, less than one third for example, of the total length L2 of the front portion 16 running from the transverse shoulder 22.

The total length L2 of the front portion 16 of the insulative sleeve 15, which is the same as the length of the metal part 11 adapted to be received into the insulative sleeve 16, is at least equal to the average outside diameter D4 of the metal part 11.

Although, as previously mentioned, the inside surface of the front portion 16 of the insulative sleeve 15 is generally cylindrical, it advantageously features some degree of taper (in the order of a few degrees, for example) to facilitate molding.

It is to allow for this taper and for any conicity of the metal part 11 that the term "average" diameter has been used in the foregoing.

As shown in the figures, the inside surface of the front portion 16 of the insulative sleeve 15 preferably has near the transverse shoulder 22 from which it extends at least one projecting centering facet 35 oblique to the axis of the connector and extending towards the transverse shoulder 22.

In practise the centering facet 35 is a plane facet which extends as far as the transverse shoulder 22 and therefore intersects it, and there are a plurality of centering facets 35 circumferentially distributed around the axis of the connector.

In the embodiment shown there are three of these centering facets 35 disposed in pairs at 120°.

Between the transverse shoulder 22 and the front portion 16 of the insulative sleeve 15, near the transverse shoulder 22, the internal surface 25 of the insulative sleeve 15 is substantially tangential to a cylindrical surface perpendicular to the transverse shoulder 22.

On either side of the transverse shoulder 22 there is a continuity of surface between the inside surface of the insulative sleeve 15 and that of the metal part 11, if the corresponding diameters D1 and D2 are equal.

In any event, as the diameter D1 is at most equal to the diameter D2 there cannot be at this point any obstacle to insertion of the electric conductor 14 if the metal part 11 is properly centered in the insulative sleeve 15.

The precise function of the centering facets 35 is to center the metal part 11 properly.

The front portion 16 and the rear portion 17 of the insulative sleeve 15 have substantially the same thickness E.

The same goes for the middle portion 27 ignoring some thickening of the latter on the far side of the transverse shoulder 22.

The exterior of the front portion 16 carries at least one projecting fin 37 forming a guard.

The fin 37 extends generally parallel to the axis of the connector from the open end of the front portion 16 to the rear portion 17 via the middle portion 27. The profile of the fin as seen in elevation comprises an oblique section running from the open end towards the rear portion 17 followed by a section aligned with the external contour of the rear portion 17; as an alternative to this, as schematically represented in chain-dotted outline in FIG. 2, this profile may be rectilinear.

In practise there are a plurality of circumferentially distributed fins 37.

In the embodiment shown there are eight fins regularly distributed in the circumferential direction.

The metal part 11 is manufactured by the usual techniques in this art, as briefly outlined hereinabove, preferably from copper.

It is preferably treated in any suitable way to give at least the portion of its external surface to which the film of adhesive 24 is applied a rough finish for better adhesion of the adhesive film 24.

For example, it may be electrolytically tinned with a matt finish and with no subsequent remelting.

Any other chemical or mechanical means of obtaining a comparable rough finish may equally well be used.

The insulative sleeve 15 is molded from an appropriate synthetic material such as polyamide, for example.

The insulative sleeves may be molded separately or preferably in necklace form.

The tabs 38 linking pairs of insulative sleeves 15 in a necklace arrangement of this kind are schematically represented in FIGS. 2, 3, 5 and 6 in chain-dotted outline.

A metal part 11 may be adhesively bonded to an insulative sleeve 15 as follows:

- a necklace of insulative sleeves 15 is placed in an assembly station,
- after degreasing, a metal part 11 is placed in each of the insulative sleeves 15, the metal parts 11 being inserted only partially or inserted completely into the insulative sleeve 15 until the edge 21 of the inner end 20 of the metal part 11 abutts the transverse shoulder 22 on the inside of the insulative sleeve 15,
- an appropriate quantity of a suitable adhesive is deposited at one point at least in the annular gap between the metal part 11 and the insulative sleeve 15, a cyanoacrylate type adhesive, for example, it being understood that if the metal part 11 has been fully inserted into the insulative sleeve 15 slight pressure is then exerted on it to prevent any running of the adhesive inside the insulative sleeve 15 and that if it is only partially inserted it is then completely inserted until the edge 21 of the inner end 20 abutts against the transverse shoulder 22, and
- (optionally) an activating agent is evaporated to accelerate polymerization at the surface of the adhesive employed so as to avoid the phenomenon of "blooming" that can cause white spots to appear on the surface of the parts concerned.

In a variation on the above method the adhesive may be deposited on the metal part 11 before it is inserted into the insulative sleeve 15.

The electric terminal connector 10 produced in this way in accordance with the invention can then be manipulated while the natural in-depth polymerization of the adhesive used in its assembly continues, to be completed after a few hours. It is, of course, preferable systematically to test the electric terminal connector 10, in the usual way.

It will be readily understood that it is by simple capillary action that the amount of adhesive employed is distributed optimally between the metal part 11 and the insulative sleeve 15, forming the required homogeneous film of adhesive 24 between the latter.

The enlarged section 29 of the front portion 16 of the insulative sleeve 16 advantageously forms around the metal part 11 an expansion chamber for the adhesive able to compensate for any variations in volume between the various component parts concerned.

Figure 7:
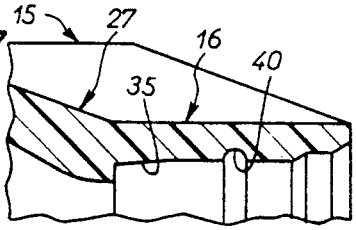
FIG. 7 is a partial view in axial cross-section analogous to that of FIG. 4 but relating to an alternative embodiment.
Figure 5:
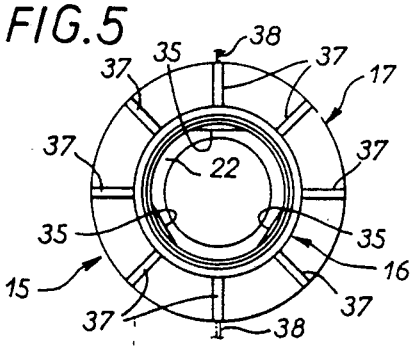
FIG. 5 in an end-on view in elevation of the insulative sleeve as seen in the direction of the arrow V in FIG. 3.
Figure 6:
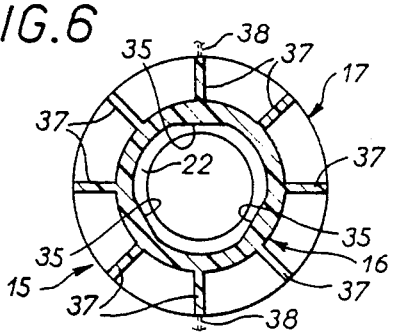
FIG. 6 is a view of it in transverse cross-section on the line VI—VI in FIG. 3.

In the alternative embodiment shown in FIG. 7 the inside surface of the front portion 16 of the insulative sleeve 15 comprises an annular groove 40 at a distance from the transverse shoulder 22 and the metal part 11 incorporates a bead (not shown) formed by expanding the metal part and engaged with the groove 40.

Apart from this bead, the metal part 11 is again entirely straight.

In the embodiment shown there is only one groove 40 which is semi-circular in transverse cross-section.

A plurality of appropriately spaced grooves 40 could, of course, be provided and one or more of them could have a cross-section that is not semi-circular.

In a further embodiment (not shown) the insulative sleeve 15 has one or more internal grooves 40 of this kind but the metal part 11 is not expanded so that it remains entirely straight over its entire length.

Because of this groove 40 a bead of adhesive is formed and then has an additional mechanical function.

The present invention is not limited to the embodiments described and shown but encompasses any variant execution thereof.

There is claimed:

1. Electric terminal connector for an insulated electric conductor having a conductive core covered by insulation, said connector comprising a generally tubular metal part adapted to fit over a previously bared end of a conductive core of an insulated electric conductor, and an insulative sleeve having a front portion receiving said tubular metal part and a rear portion having a cross section greater than that of said front portion adapted to fit over insulation of the insulated electric conductor adjacent the bared end, said insulative sleeve comprising an internal transverse shoulder, the rear portion of said tubular metal part being right cylindrical and having an end bearing against said transverse shoulder, an adhesive film at least locally extending between said tubular metal part and said insulative sleeve to bond them together, said insulative sleeve having an internal surface adjoining said transverse shoulder, said internal surface having a diameter at most equal to that of an inside surface of said tubular metal part, said front portion of said insulative sleeve having an internally enlarged section at an open end thereof axially remote from the transverse abutment.

2. Connector according to claim 1 wherein said internal surface of said front portion of said insulative sleeve comprises in succession and starting from said transverse shoulder a first section with an average diameter slightly larger than the average outside diameter of the rear end of said metal part and a larger second section with an average diameter greater than that of said first section.

3. Connector according to claim 2 wherein the internal surface of said larger second section of said front portion of said insulative sleeve comprises a substantially cylindrical middle section between two generally frustoconical end sections, one of which merges with said first section and the other of which forms an insertion-assisting chamfer at the open end of said insulative sleeve.

4. Connector according to claim 1 wherein the axial length of said larger second section of said front portion of said insulative sleeve is only a fraction of the total length of said front portion running from said transverse shoulder.

5. Connector according to claim 1 wherein said internal surface of said front portion of said insulative sleeve includes at least one annular groove spaced from said transverse shoulder.

6. Connector according to claim 5, wherein said metal part incorporates an annular bead engaged in the annular groove in said insulative sleeve.

7. Connector according to claim 1 wherein said metal part is right cylindrical over its entire length.

8. Connector according to claim 1 wherein between said transverse shoulder and said front portion of said insulative sleeve, near said transverse shoulder, said internal surface of said insulative sleeve is substantially right cylindrical.

9. Connector assembly according to claim 1 wherein said front portion of said insulative sleeve is generally cylindrical and said rear portion of said insulative sleeve is generally cylindrical and further comprising a generally frustoconical middle portion of said insulative sleeve joining said front and rear portions.

10. Connector according to claim 9 wherein said front and rear portions of said insulative sleeve are substantially the same thickness.

11. Connector according to claim 1 wherein the length of said tubular metal part adapted to be received into said insulative sleeve is at least equal to the average outside diameter of said tubular metal part.

12. Connector according to claim 1 wherein a portion of the external surface of said metal part in contact with said adhesive film has a rough finish.

13. Connector according to claim 1 wherein said tubular metal part is made from tinned copper.

14. Electric terminal connector for an insulated electric conductor having a conductive core covered by insulation, said connector comprising a generally tubular metal part adapted to fit over a previously bared end of a conductive core of an insulated electric conductor, and an insulative sleeve having a front portion receiving said tubular metal part and a rear portion having a cross section greater than that of said front portion adapted to fit over insulation of the insulated electric conductor adjacent the bared end, said insulative sleeve comprising an internal transverse shoulder, the rear portion of said tubular metal part being right cylindrical and having an end bearing against said transverse shoulder, an adhesive film at least locally extending between said tubular metal part and said insulative sleeve to bond them together, said insulative sleeve having an internal surface, adjoining said transverse shoulder, said internal surface having a diameter at most equal to that of an inside surface of said tubular metal part, said internal surface of said front portion of said insulative sleeve generally tapering axially inwardly.

15. Electric terminal connector for an insulated electric conductor having a conductive core covered by insulation, said connector comprising a generally tubular metal part adapted to fit over a previously bared end of a conductive core of an insulated electric conductor, and an insulative sleeve having a front portion receiving said tubular metal part and a rear portion having a cross section greater than that of said front portion adapted to fit over insulation of the insulated electric conductor adjacent the bared end, said insulative sleeve comprising an internal transverse shoulder, the rear portion of said tubular metal part being right cylindrical and having an end bearing against said transverse shoulder, an adhesive film at least locally extending between said tubular metal part and said insulative sleeve to bond them together, said insulative shoulder having an internal surface, adjoining said transverse shoulder, said internal surface having a diameter at most equal to that of an inside surface of said tubular metal part, near said transverse shoulder said internal surface of said front portion of said insulative sleeve having at least one oblique chordal centering facet angling inwardly toward the axis of said connector as said facet extends toward the transverse shoulder.

16. Connector according to claim 15 wherein said centering facet penetrates into said transverse shoulder.

17. Connector according to claim 15 comprising a plurality of said centering facets circumferentially spaced on said internal surface of said front portion.

18. Electric terminal connector for an insulated electric conductor having a conductive core covered by insulation, said connector comprising a generally tubular metal part adapted to fit over a previously bared end of a conductive core of an insulated electric conductor, and an insulative sleeve having a front portion receiving said tubular metal part and a rear portion having a cross section greater than that of said front portion adapted to fit over insulation of the insulated electric conductor adjacent the bared end, said insulative sleeve comprising an internal transverse shoulder, the rear portion of said tubular metal part being right cylindrical and having an end bearing against said transverse shoulder, an adhesive film at least locally extending between said tubular metal part and said insulative sleeve to bond them together, said insulative sleeve having an internal surface, adjoining said transverse shoulder, said internal surface having a diameter at most equal to that of an inside surface of said tubular metal part, said connector having a longitudinal axis and at least one fin extending along an exterior surface of said insulative sleeve generally parallel to the axis of the connector from an open end of said front portion of said insulative sleeve to said rear portion thereof, said at least one fin defining means for limiting or preventing penetration into a connection terminal wherein the profile of said at least one fin in elevation comprises an oblique section running from the open end of said front portion of said insulative sleeve followed by a section aligned with the external contour of said rear portion thereof.

19. Connector according to claim 18 wherein the profile of said at least one fin is rectilinear.

20. Connector according to claim 18 comprising a plurality of circumferentially distributed fins.

* * * * *